United States Patent [19]

Gruber et al.

[11] 4,254,627

[45] Mar. 10, 1981

[54] STEAM TURBINE PLANT

[75] Inventors: Helmut Gruber, Baden; Kurt Reinhard, Neuenhof, both of Switzerland

[73] Assignee: BBC Brown Boveri & Company Limited, Baden, Switzerland

[21] Appl. No.: 55,809

[22] Filed: Jul. 9, 1979

[30] Foreign Application Priority Data

Aug. 10, 1978 [CH] Switzerland ..... 8510/78

[51] Int. Cl.[3] ..... F01K 13/02

[52] U.S. Cl. ..... 60/646

[58] Field of Search ..... 60/646, 653, 657, 663, 60/666, 677, 679

[56] References Cited

U.S. PATENT DOCUMENTS 3,277,651 10/1966 Augsburger ..... 60/657

4,132,076 1/1979 Weiss ..... 60/663

*Primary Examiner*—Stephen A. Kreitman

*Attorney, Agent, or Firm*—Burns, Doane, Swecker & Mathis

[57] ABSTRACT

A steam turbine plant is disclosed having at least one intermediate superheater which is connected to an outlet side of a high-pressure turbine by way of a check valve. A discharge pipe line is connected at one end through a flow-regulating unit to an outlet side of the high-pressure turbine upstream of the check valve and at the other end to a condenser of the plant. The flow-regulating unit is controlled in response to various pressure parameters sensed within the system. The discharge pipe line both improves the idling capability of the plant and reduces the time required to reach operating temperatures from a cold start.

13 Claims, 2 Drawing Figures

STEAM TURBINE PLANT

BACKGROUND AND SUMMARY OF THE PRESENT INVENTION

The present invention relates generally to steam plants having at least one intermediate superheater.

In conventional power plants having turbine systems containing interstage superheaters and by-pass arrangements of large capacity, a pressure reduction in the superheater will take place relatively slowly after a load cut-off at the turbine, followed by a fully opened by-pass. For example, boilers heated by coal and not shut down in the case of a load cut-off at the turbine, will have a load dissipation gradient (in minutes) of 5%/minute. In the case of a proper load dissipation at the boiler, it is likely that the pressure in the intermediate superheater will require at least 15 minutes before being reduced so as to correspond to the pressure of minimum boiler load.

If the turbine plant is operated at no load or internal power only (with a higher pressure in the intermediate superheater), a limited amount of steam will flow through the high-pressure turbine. This limited amount of steam will usually not be sufficient to dissipate windage heat generated due to the pressure build-up in the intermediate superheater. The excess windage heat may in turn possibly cause an uncontrollable temperature rise in the exhaust steam of the high-pressure turbine. Alternatively, the excess windage heat may cause a limited idling capacity. Therefore, between the moment of load cut-off and the occurrence of the necessary lower pressure in the intermediate superheater there will be a period of time during which the temperature is out-of-control with the potential danger of serious damage occurring within the turbine plant.

Turbine plants which are equipped with interstage superheaters and both high- and low-pressure by-passes have the further disadvantage of an extended starting period in the case of a cold start. The extended starting period occurs because a sudden rise in temperature will occur at the very beginning of the turbine run which is caused by the pressure built up in the intermediate superheater in accordance with the boiler load and which pressure build up will attenuate the acceleration gradient.

Attempts have been made to alleviate these problems (i.e., a proper idling capability after a load cut-off and optimum cold start behavior) by an alignment of the turbine relief valves relative to the intake valves or by some other measures. These procedures, however, fail to lead to an overall solution which would be satisfactory even in a marginal situation.

Accordingly, it is a primary object of the present invention to provide a steam turbine plant which does not have the disadvantages of the present-day plants discussed above, wherein (even in the case of a by-pass capacity of up to 100%) a load cut-off at the turbine will not require a tripping of the boiler.

Another object of the present invention is to provide a steam turbine plant wherein the plant can be reduced properly to a minimum load and operated under these conditions at no load or under internal power for any desired period of time. In this way, the unit will be ready immediately, e.g., after the elimination of a fault in the power system.

Finally, still another object of the present invention is to provide a steam turbine plant having a relatively shorter cold-starting time than the known steam turbine plants due to the simultaneous heating of the high-pressure and the medium-pressure turbines.

A steam turbine plant according to the present invention includes a discharge pipe line having a flow-regulating unit which by-passes the intermediate superheater. One end of the discharge pipe line is connected on a line between the check valve and the high-pressure turbine on the outlet side of the latter, and the other end of the discharge pipe line is connected with the intake side of a condenser.

In a further embodiment of the present invention, it is desirable to provide at least one high-pressure feed water heater between the feed tank and the boiler. The high-pressure feed water heater is connected at the steam side between the high-pressure turbine and the check valve (which check valve is arranged between the high-pressure turbine and the intermediate superheater on the outlet side of the high-pressure turbine) by way of a high-pressure steam conduit. As a result of this arrangement, the feed water temperature will be automatically lowered to a certain degree so that the boiler will be able to reduce the load more rapidly. Furthermore, in the case of this particular embodiment, the steam (prohibited by the closed check valve from entering the intermediate superheater) will reach the high-pressure feed water heater so that the conditions of heat balance will not be affected significantly so far as the boiler is concerned.

In connection with this arrangement it will also be advantageous to connect the flow-regulating unit (located within the discharge pipe line) to a control device. The control device is preferably arranged to maintain the flow-regulating unit in a closed configuration during the start of the turbine plant until a pre-set discharge pressure has been reached by the high-pressure turbine. The control device will then regulate the open position of the flow-regulating unit is such a manner that the pressure within the high-pressure turbine will not exceed the predetermined pressure value.

At the time of parallel connection of the generator with the power network, the open position of the flow-regulating unit is held either until a pre-set minimum threshold load value has been reached, or until the pressure at the inlet and outlet sides of the check valve (arranged between the high-pressure turbine and the intermediate superheater) has been approximately equalized. The flow-regulating unit will be closed when the turbine load increases still further.

BRIEF DESCRIPTION OF THE DRAWINGS

Preferred embodiments of the present invention will now be described in detail with reference to the accompanying drawings wherein like members bear like reference numerals and wherein.

DETAILED DESCRIPTION OF THE PREFERRED EMBODIMENTS

Figure 1:
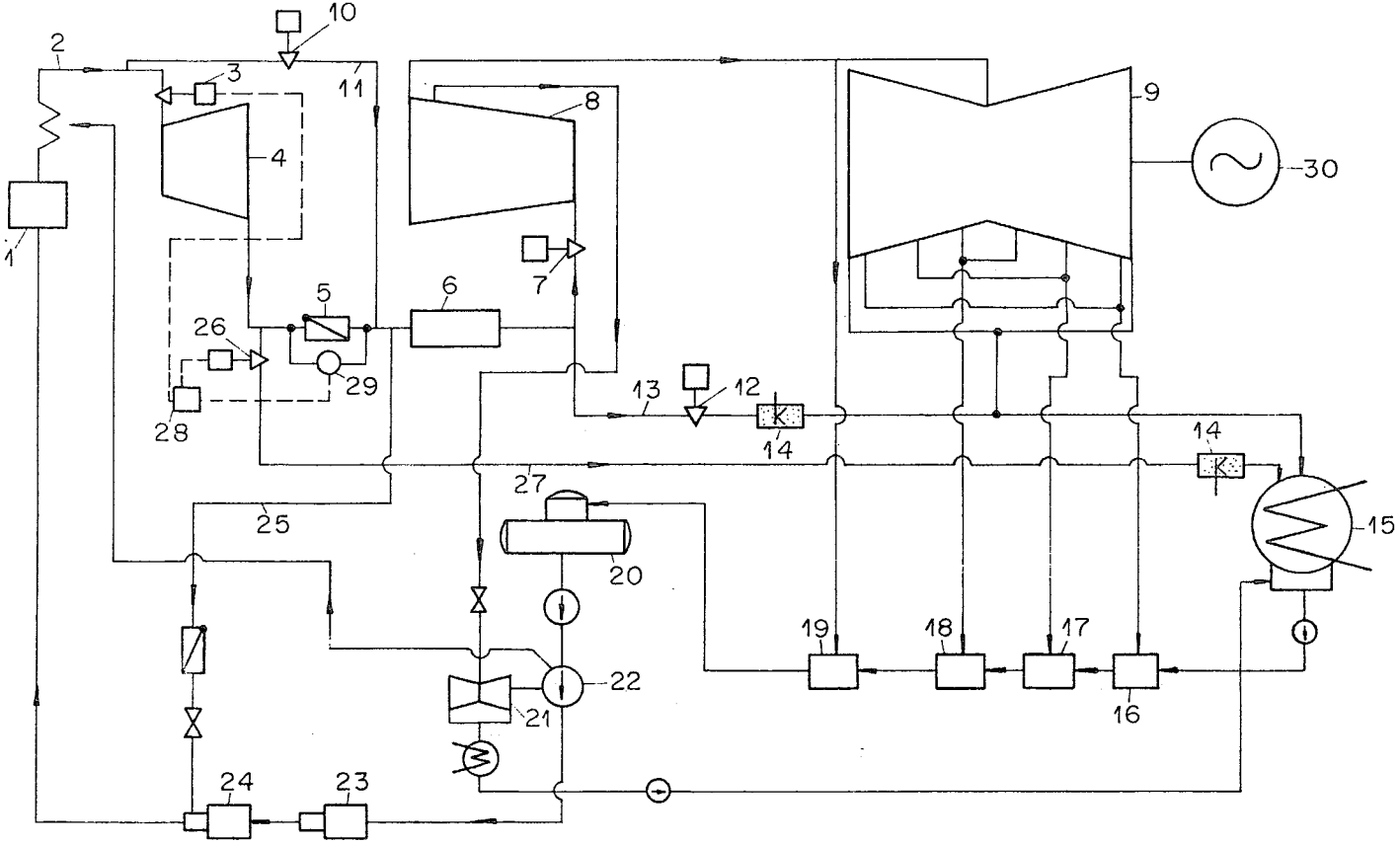
FIG. 1 is a schematic view of a first embodiment of a steam turbine plant according to the present invention; and, FIG. 2 is a schematic view of a second embodiment of a steam turbine plant according to the present invention.

With reference now to FIG. 1, a steam turbine plant according to the present invention includes a boiler 1 from which live steam is conducted to a high-pressure turbine 4 by way of a live steam pipe line 2 and a feed valve 3. During normal operation, the steam is conducted from the high-pressure turbine 4 to a low-pressure turbine 9 by way of a check valve 5, an intermediate superheater 6, a relief valve 7 and a medium-pressure turbine 8.

The steam turbine plant further includes both a high-pressure by-pass 11 (having a high-pressure by-pass valve 10) and a low-pressure by-pass 13 (having a low-pressure by-pass valve 12). A water-injection device 14 is provided downstream of the by-pass valve 12. The outlet of the low-pressure turbine 9 is connected with a condenser 15. Condensation product proceeds from the condenser 15 in a known manner successively to four preheaters 16, 17, 18 and 19 and from there the product proceeds to a feed tank 20 which functions as a fifth preheater. An auxiliary turbine 21 returns the condensation product from the feed tank 20 to the boiler 1 by way of a sixth preheater 23 and a seventh preheater 24 by a pump 22. The pump 22 is connected to the auxiliary turbine. The high-pressure preheater 24 is connected at the steam side (between the check valve 5 and the intermediate superheater 6) with the high-pressure exhaust system by way of a high-pressure steam conduit 25.

In accordance with the present invention, a discharge pipe line 27, having a flow-regulating unit 26, by-passes the intermediate superheater 6. The pipe line 27 is connected both between the check valve 5 and the high-pressure turbine 4 on the outlet side of the turbine and also with the intake side of the condenser 15.

The flow-regulating unit 26 is controlled both by a device 29 (which device senses the difference in pressure across the check valve) and a governing device 28 in such manner that the unit 26 will completely open at standstill or idling of the plant and will close only when the load increases. The value of closing may preferably be set between 7 to 12% of the load as desired. The flow-regulating unit 26 is controlled in a relatively simple manner by a load signal or by a signal of the feed valve 3. The flow regulating unit will also begin to close when the high-pressure exhaust steam pressure has become substantially equal to the intermediate superheater pressure. This equalization of pressure will be the result of increasing turbine load, a state which is being determined by the pressure-difference sensing device 29.

Figure 2:
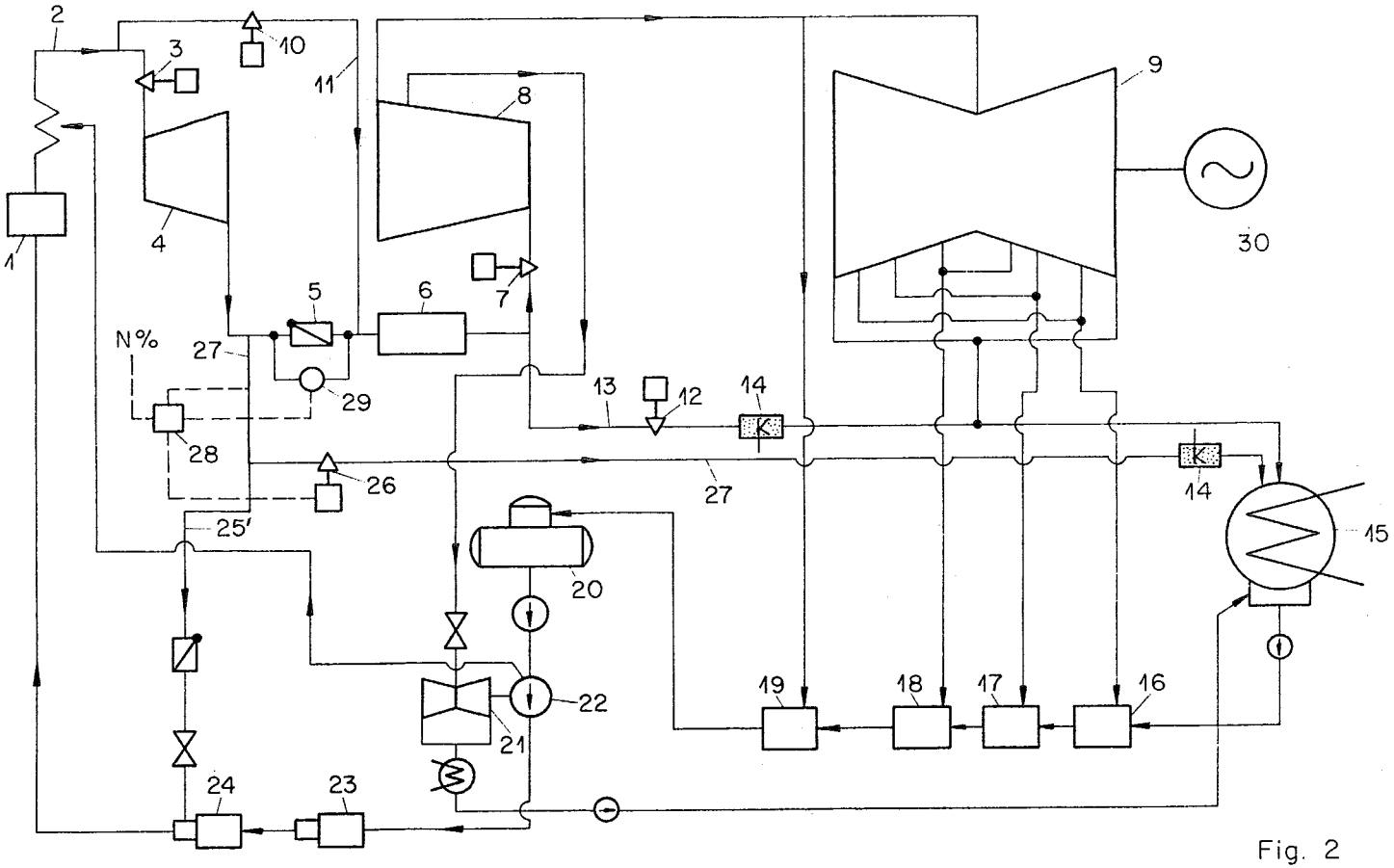

The steam turbine plant of FIG. 2 differs from the plant of FIG. 1 primarily by the feature that the seventh preheater 24 is connected at the steam side with the outlet side of the high-pressure turbine 4 between the high-pressure turbine 4 and the check valve 5 by way of a high-pressure steam conduit 25'.

With reference to FIG. 2, the flow-regulating unit 26, placed within the discharge pipe line 27, is connected with the control devices 28, 29 which are arranged in such a manner that the flow-regulating unit 26 will be closed during the start of the turbine plant until the discharge pressure of the high-pressure turbine 4 has reached a pre-set value (for example, 7.5 bar). In this way, the entire exhaust steam of the high-pressure turbine 4 will be conducted to the seventh preheater 24 with the preheater 24 functioning as a condenser for the exhaust steam. The steam which in this case will not enter the intermediate superheater 6 does reach the seventh preheater 24 with the result that the state of boiler 1 will change only insignificantly with respect to heat-balance.

When the turbine plant accelerates further, the flow-regulating unit 26 will open as soon as the absorption capacity of the high-pressure preheater 24 is being exceeded. The open position is regulated by the control device 28 so that the pressure at the outlet of the high-pressure turbine 4 will not go beyond the pre-set pressure value, for example, 7.5 bar. In this way any undue temperature rise in the high-pressure exhaust system is prevented. At the time of parallel connection of the generator 30 with the power network, the existing open position of the flow-regulating unit 26 is held until a pre-set minimum threshold load value has been reached, or until the pressures at the inlet and outlet sides of the check valve 5 become approximately equal. Such a condition is determined by the pressure-difference sensing device 29. The flow-regulating unit 26 is thereby closed when the turbine load has increased to the desired operating value.

A steam turbine plant according to the present invention makes possible an optimum cold start of the turbine aggregate because all of the turbine housings are being heated simultaneously, allowing a significant shortening of the starting period. Problems connected with windage heat in the high-pressure turbine due to a built-up pressure in the intermediate superheater will not arise. A reduction in the dimension of the low-pressure by-pass, i.e., a higher intermediate superheater pressure than in the case of presently known plants, is also feasible. A problem-free load cut-off and re-loading of the turbine, unaffected by the operative boiler load, is also possible.

The principles, preferred embodiments, and operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A steam turbine plant comprising:

a steam supply pipe;

a first turbine supplied by said steam supply pipe;

a first turbine outlet;

at least one superheater connected to the turbine outlet;

a discharge pipe line joined at a first connection between the high-pressure turbine outlet and the superheater;

means for regulating the flow in the discharge pipe line; and control means for opening and closing the means for regulating the flow in said discharge pipe in response to at least one pressure within the steam turbine plant.

2. A steam turbine plant as in claim 1 including:

a check valve located between the first connection and the superheater.

3. A steam turbine plant as in claim 2 wherein said control means includes means for sensing the pressure on either side of the check valve so that the control means will close the means for regulating flow in the discharge pipe line when the two pressures are substantially equal.

4. A steam turbine plant as in claim 3 including:

a boiler in the steam supply pipe; and at least one feed water heater connected at one end between the first turbine outlet and the check valve and connected at the other end to the inlet of the boiler.

5. A steam turbine plant as in claim 4 wherein said control means maintains the means for regulating the flow in the discharge pipe line in a closed condition until a predetermined discharge pressure at the first turbine outlet has been attained.

6. A steam turbine plant as in claim 3 including:

a boiler in the steam supply pipe;

at least one feed water heater connected at one end between the check valve and the superheater and connected at the other end to the inlet of the boiler.

7. A steam turbine as in claim 6 wherein the control means maintains the means for regulating the flow in the discharge pipe line in an open condition until a predetermined discharge pressure at the first turbine outlet has been attained.

8. A steam turbine as in claim 3 further comprising:

a condenser;

a second turbine; and first pipe means for connecting the outlet of the superheater to the inlet of the second turbine and second pipe means for connecting the outlet of the superheater to the inlet of the condenser;

first means for regulating the flow in the first pipe means; and second means for regulating the flow in the second pipe means.

9. A steam turbine plant as in claim 1 including a by-pass line connected at one end to the steam supply pipe and connected at the other end to the first turbine outlet on the inlet side of the superheater.

10. A method of operating a steam turbine plant comprising the steps of:

supplying steam to a first turbine;

conducting steam from an outlet of the first turbine to at least one superheater;

discharging the steam from the outlet of the first turbine before the steam reaches the superheater in response to at least one pressure within the steam turbine plant;

connecting a check valve upstream of the superheater and downstream of the discharging of the stream from the outlet of the first turbine;

sensing the pressure on either side of the check valve; and preventing the discharging of the steam from the outlet of the first turbine when the pressures on either side of the check valve are substantially equal.

11. The method of claim 10 further comprising the steps of:

connecting a feed water heater between the first turbine and the check valve;

preventing the discharging of the steam from the outlet of the first turbine when starting the steam plant; and allowing the discharging of the steam from the outlet of the first turbine when a predetermined outlet pressure of the first turbine in attained.

12. The method of claim 11 further comprising the steps of:

connecting a generator to an output of the steam turbine plant; and preventing the discharging of the steam from the outlet of the first turbine when a predetermined threshold load value has been attained.

13. The method of claim 10 further comprising the steps of:

connecting a feed water heater between the check valve and the superheater;

allowing the discharge of the steam from the outlet of the first turbine when starting the steam plant; and preventing the discharging of the steam from the outlet of the first turbine when a predetermined outlet pressure of the first turbine is attained.

* * * * *